United States Patent [19]

Cramer et al.

[11] 4,203,821

[45] May 20, 1980

[54] APPARATUS FOR CARRYING OUT ELECTROCHEMICAL REACTIONS AND CORRESPONDINGLY SUITABLE BIPOLAR ELECTRODES

[75] Inventors: Jürgen Cramer; Werner Lindner, both of Eppstein, Fed. Rep. of Germany

[73] Assignee: Hoechst Aktiengesellschaft, Frankfurt, Fed. Rep. of Germany

[21] Appl. No.: 938,049

[22] Filed: Aug. 30, 1978

[30] Foreign Application Priority Data

Sep. 1, 1977 [DE] Fed. Rep. of Germany ..... 2739324

[51] Int. Cl.[2] ..... C25B 9/00; C25B 9/02; C25B 11/12; C25B 11/02

[52] U.S. Cl. ..... 204/268; 204/269; 204/286; 204/290 R; 204/294

[58] Field of Search ..... 204/268–270, 204/290 R, 297 R, 72, 294, 286

[56] References Cited

U.S. PATENT DOCUMENTS

| | | | |
|---|---|---|---|
| 799,061 | 9/1905 | Kellner | 204/268 |
| 3,451,906 | 6/1969 | Weed | 204/269 |
| 3,915,836 | 10/1975 | Born et al. | 204/286 |
| 4,118,294 | 10/1978 | Pellegvi | 204/270 X |
| 4,140,616 | 2/1979 | Wheatley et al. | 204/269 X |

FOREIGN PATENT DOCUMENTS

| | | | |
|---|---|---|---|
| 1299287 | 7/1969 | Fed. Rep. of Germany | 204/128 |
| 186981 | 2/1967 | U.S.S.R. | 204/268 |

*Primary Examiner*—John H. Mack
*Assistant Examiner*—D. R. Valentine
*Attorney, Agent, or Firm*—Curtis, Morris & Safford

[57] ABSTRACT

Electrochemical, especially organo-electrochemical, reactions are carried out with improved current efficiency in a continuous-flow cell with the use of bipolar electrodes placed in a frame of non-conducting material, especially a polyolefin. Preferably, the electrically active part of the electrodes consists of glass-like carbon the cathode face of which is coated with a material reducing the hydrogen overvoltage, for example titanium carbide or tungsten carbide.

9 Claims, 2 Drawing Figures

Figure 1:
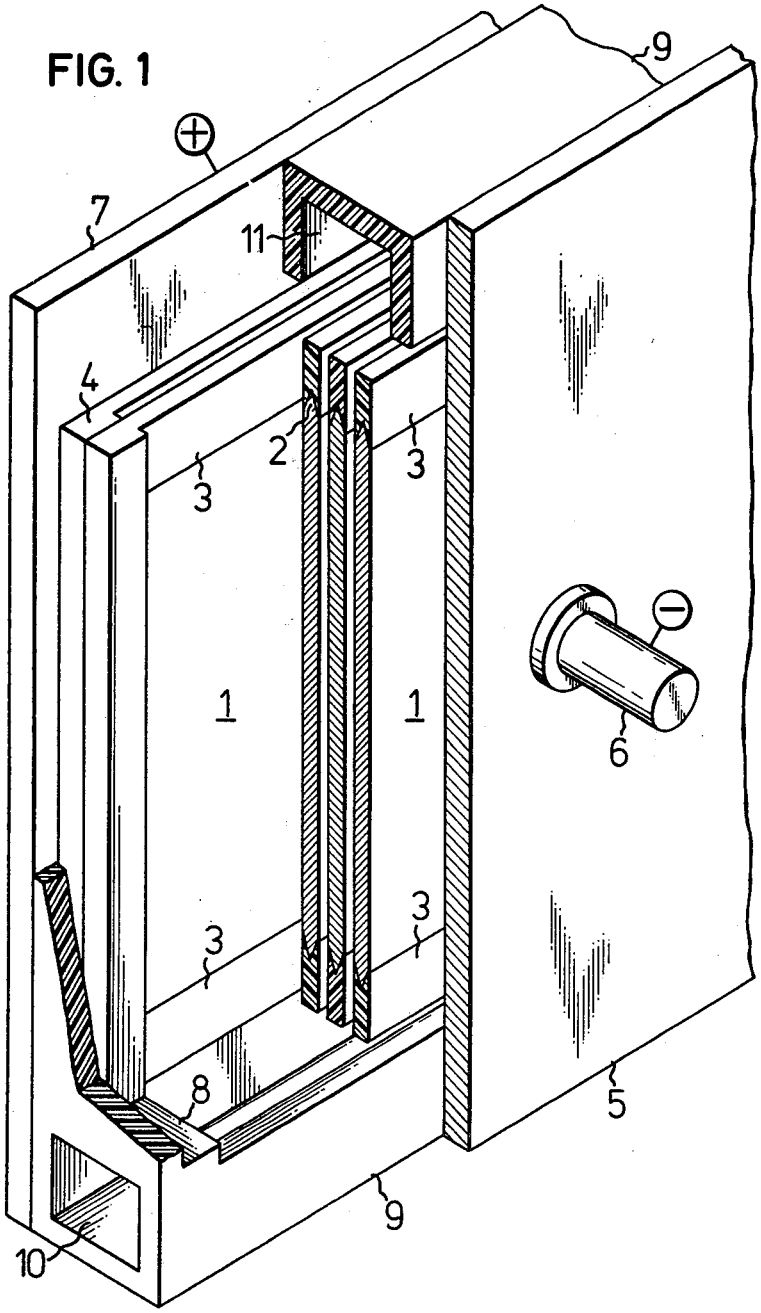

APPARATUS FOR CARRYING OUT ELECTROCHEMICAL REACTIONS AND CORRESPONDINGLY SUITABLE BIPOLAR ELECTRODES

It is known that piles of optionally coated graphite plates separated from one another by non-conducting strips can be used for carrying out electrochemical, especially organo-electrochemical, reactions in undivided electrolysis cells ("capillary cap cell", see German Offenlegungsschriften Nos. 18 04 809; 2,502,167 and 2,502,840).

When in these cells thin electrodes are used as bipolar electrodes, for examples because they are made from a material such as glass-like carbon which can be manufactured up to a maximum thickness of about 4 mm only, or because expensive electrode material is not to be used, or because the space/time yield of the cell is to be increased (see Fritz Beck, Elektroorganische Chemie, Ed. Verlag Chemie 1974, pp. 124 and 126–128), the current efficiency obtainable is considerably lower than that of electrode plates of unipolar connection, in the case of anodic benzene methoxylation for example by up to 30%.

It was therefore the object of this invention to improve the known capillary gap cells having a bipolar electrode connection in such a manner that the current efficiency obtainable in these cells is not inferior to that of cells having electrode plates of unipolar connection.

In accordance with this invention, the above object was achieved in a surprising and simple manner by framing the electrodes of bipolar connection in a non-conducting material which, of course, has to be stable and inert to the electrolytes used and under the prevailing electrochemical conditions.

Subject of this invention is therefore a process for carrying out electrochemical reactions in a continuous-flow cell containing electrodes of bipolar connection, which comprises using bipolar electrodes positioned in a frame made from a non-conducting material.

As materials non-conductors of electricity there may be used all known non-conducting materials, for example plastics, ceramic materials or rubber, inasmuch as they are stable under the prevailing electrolysis conditions. Preferred are thermoplastic materials such as polyolefins, polyesters, polyamides, halogenated polymers (polyvinyl chloride etc.), in which the electrically active plates may be framed for example by injection-molding. Especially advantageous are polyolefins such as polyethylene, polypropylene or polystyrene.

Subject of this invention is furthermore an apparatus for carrying out the above process which consists of a continuous-flow cell containing anode, cathode and at least one electrode of bipolar connection, wherein the bipolar electrode(s) is (are) positioned in a frame of non-conducting material.

The number of bipolar plates used, which are in principle of any shape, preferably, however, at least approximately square or rectangular, is not critical and substantially depends on the operating voltage required for an individual cell and the total voltage at disposal. Thus, the number of plates may be from 1 to about 100; generally, it is from about 10 to 50.

For the electrically active part of the bipolar electrodes in accordance with this invention, all known electrode materials, for example metals, graphite or coal, can be used. A preferred material is glass-like carbon, because of its high resistance to corrosion, especially in organic electrolytes.

The electrically active part of the electrodes may alternatively be formed in known manner by two or more layers of different electrode materials, or a basis material may be coated with the genuine electrode material, for example in order to ensure that the counter-electrode process inevitably occuring in any electrolysis proceeds at an overvoltage as low as possible, thus causing a correspondingly low energy consumption only. According to a preferred embodiment of the invention, in anodic reactions the electrically active part of the bipolar electrodes consists of a thin plate of glass-like carbon the cathode face of which is coated in order to reduce the hydrogen overvoltage, for example with gold, platinum metals, nickel, iron, copper or contact metal carbides such as titanium carbide or tungsten carbide.

In principle, the bipolar electrodes may have any thickness. In order to save material and to obtain high space/time yields, however, they have generally a thickness of up to a maximum 5 to 7 mm approximately, preferably of from about 1.5 to 3 mm. Plates or sheets having a still lower thickness may be chosen in principle; their mechanical stability, however, is generally insufficient, especially when they are made from coal or graphite.

The frame of the bipolar electrodes is maintained in place by suitable rim profiles of the electrode plates. For example, in the case where metal electrodes are used, the rim section may have a thickness slightly below that of the main plate area, and the recess so formed is then filled with the frame material in such a manner that the rim of the plate is completely imbedded in the frame material, and thus isolated. Additional perforation of this recessed rim, on injection-molding of the thermoplastic material, brings about an increased cohesion of frame and plate, because the plastic material solidly fixes with each other the two parts of the frame situated on both sides of the plate.

According to a preferred embodiment of the invention, the rims of, for example, plates of glass-like carbon are prismatically tapered, so that the frame of the bipolar electrodes is held by the new edge so formed. Of course, other methods and means suitable for linking different materials can be applied alternatively.

The necessary width of the frames is determined by the specific resistance of the electrolytes and the electrode material used. With increasing specific conductivity of the electrolytes and increasing resistance of the electrode material, the width of the frame has to be increased, too. Generally, the width of the frames made from non-conducting materials is from about 3 to 50 mm, preferably from about 10 to 25 mm. The thickness of the frame corresponds normally to that of the electrically active plate; however, the frame may alternatively be thinner than this plate. Preferred are frames where that part which is positioned parallelly to the direction of electrolyte flow is thicker by about 0.2 to 5 mm than the electrically active plate, and where that part which is positioned transversally to the direction of electrolyte flow has about the same thickness as this plate, thereby automatically ensuring adjustment of the intended electrode distances within the pile of several bipolar electrodes in accordance with this invention without hindering the flow. The separate spacers made from non-conducting materials usually employed which are prone to be shifted out of place in the course of the operations can thus be omitted. The broadened rims of the bipolar electrodes in accordance with this invention intercept the pressure necessary for the cohesion and thus prevent breaking of brittle material such as glass-like carbon.

This risk of break can be further reduced by additionally placing in known manner nets of non-conducting materials stable under electrolysis conditions between the bipolar electrodes according to the invention.

These nets between the electrode plates have furthermore the advantage of acting as generators of turbulences which increase the transport of substance to the electrode surfaces. The nets may be manufactured from all materials stable in the electrolyte, preferably from synthetic yarns, for example yarns of polyolefins, polyesters, polyamides or halogenated polymers.

The framing of the electrodes in accordance with this invention allows furthermore a tile-shaped structure of large bipolar electrodes consisting of several smaller electrodes of the kind as described. This may be achieved by linking the frames of the individual electrodes, for example by screwing, riveting, welding or fusing, and it is advantageous to do so when using glass-like carbon which cannot be manufactured in the form of plates having any size whatsoever.

The invention will be better understood by reference to the accompanying drawings, which represent an exemplified embodiment of the apparatus in accordance with the invention:

FIG. 1 represents a sectional view of a cell containing 4 bipolar electrodes. The rims (2) of the plates (1) consisting of electrically active material are prismatically tapered and inserted in the frame parts (3) and (4). The frame part (3) has the same thickness as the electrically active part (1) of the electrode and is positioned vertically to the direction of electrolyte flow. The frame (4) in parallel position to the direction of electrolyte flow is thicker than the electrically active part of the electrode, and simultaneously, it acts as spacer. The outer plate (5) acts simultaneously as contact electrode to which the current is supplied via the terminal (6), while the outer plate (7) is connected to d.c. current in analogous manner. The bipolar electrodes are placed on the projecting piece (8) at the lower end of the cell body (9) and are supplied with electrolyte from the bottom via the electrolyte inlet tunnel (10), which electrolyte is discharged via the upper collecting tunnel (11).

Figure 2:
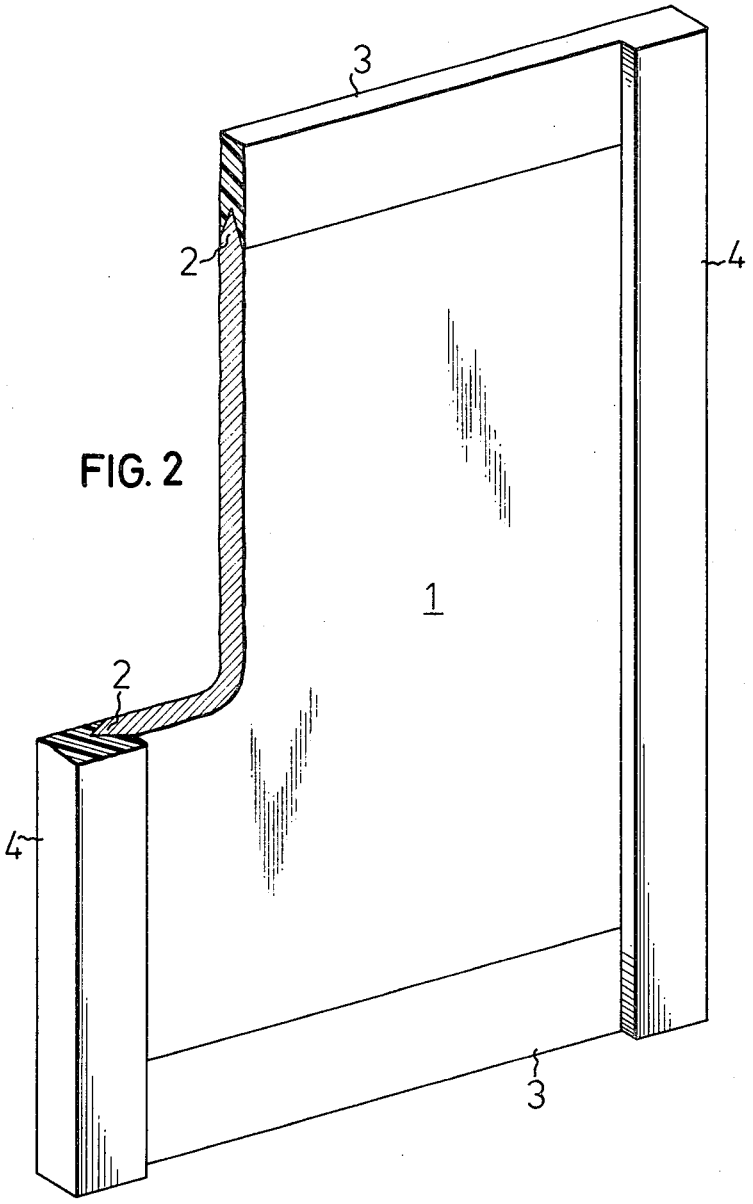

FIG. 2 represents a sectional view of an electrode in accordance with the invention. The electrically active part (1) having the tapered rim (2) is inserted into the frame parts (3) and (4) vertically and parallelly, respectively, to the direction of electrolyte flow.

The invention can be advantageously applied to all kinds of electrolyses proceeding in undivided cells, especially organic electrolyses, for example methoxylation of aromatics or amides in methanol, dimerization of acrylonitrile to adipic acid dinitrile, anodic coupling or olefin epoxidation.

The following electrolysis examples of anodic benzene methoxylation illustrate the improved action of the bipolar electrodes in accordance with the invention. Comparative Example I indicates the current efficiency attained in an equivalent unipolar apparatus, while Comparative Example II demonstrates the reduction of current efficiency when using a normal pile of plates (without frames). Example 1 demonstrates the considerable improvement by employing electrodes according to the invention, and Examples 2 and 3 show different embodiments of the invention.

COMPARATIVE EXAMPLE I

A continuous-flow cell was provided with an anode of glass-like carbon (dimensions: 195×195×2.8 mm, corresponding to 380 $cm^2$ of active electrode area) and a nickel cathode (195×195×2.5 mm) in such a manner that the edges of these electrodes which were in parallel position to the direction of electrolyte flow were in close contact with the side wall of the cell. The electrodes were maintained at a distance of about 1 mm from each other by means of a polyethylene net (195×195 mm, width of meshes 2 mm, yarn thickness about 0.5 mm). This cell was connected to a circulation apparatus provided with centrifugal pump, heat exchanger and degassing vessel. In this test plant, a mixture of 3150 g benzene 10,080 g methanol, 605 g tetramethylammonium fluoride and 50 g hydrogen fluoride was electrolyzed. After 3329 amperes/hour, at a cell voltage of 6.5 to 7 volts and 76 amperes, had passed through the solution, the electrolyte contained 8.84 mols benzoquinone-tetramethyl-ketal, which corresponds to a current efficiency of 42.7% of the theory.

COMPARATIVE EXAMPLE II

In the cell provided with electrolysis devices and circulation apparatus as used in Comparative Example I, a pile of electrodes was mounted which consisted of an anode of glass-like carbon, a nickel cathode and 5 bipolar electrodes of glass-like carbon, the cathode faces of which were nickel-coated. The dimensions of each electrode were 195×195×2.5 mm (corresponding to 6×380 $cm^2$ of active anode area), and the electrodes were separated from one another by a polyethylene net having a thickness of 1 mm. Using this pile of electrodes, a mixture of 1500 g benzene, 5000 g methanol, 325 g tetramethylammonium fluoride and 30 g hydrogen fluoride was electrolyzed for 5 hours 15 minutes at 76 amperes and a cell voltage of 35 to 42 volts (corresponding to 2400 amperes/hour) after which period of time the electrolyte contained 4.63 mols of benzoquinone-tetramethyl-ketal, corresponding to a current efficiency of 31.0% of the theory.

EXAMPLE 1

In the cell provided with electrolysis devices as used in Comparative Example I, a pile of framed electrodes according to FIG. 2 of the accompanying drawings was mounted, which consisted of an anode of glass-like carbon, a nickel cathode and 4 bipolar electrodes of glass-like carbon framed in polyethylene, the cathode faces of which were nickel-coated. The length of the electrically active part of each electrode was 150 mm parallelly to the direction of electrolyte flow, and 170 mm vertically to this direction, corresponding to 255 $cm^2$ each of active anode or cathode area per electrode. The polyethylene frame of each electrode was maintained in place by the tapered, 2 mm projecting rim of the electrically active plate. The frame had a width of 22 mm vertically to the direction of electrolyte flow and a thickness of 2.5 mm (=thickness of the plate), while parallelly to the direction of electrolyte flow its width was 12 mm and its thickness 3.5 mm. For additional generation of turbulences, polyethylene nets (150×170× about 1 mm) were placed between the electrodes. Using this pile of electrodes, a mixture of 1500 g benzene, 4800 g methanol, 345 g tetramethylammonium fluoride and 34 g hydrogen fluoride was electrolyzed for 6 hours 22 minutes at 51 amperes and a cell voltage of 32 to 35 volts (corresponding to 1620 amperes/hour), after which period of time the electrolyte contained 4.27 mols benzoquinone-tetramethyl-ketal, corresponding to a current efficiency of 42.4% of the theory.

EXAMPLE 2

In the pile of electrodes as described in Example 1, the 4 bipolar electrodes having a nickel coating were replaced by 4 similar electrodes having a titanium carbide coating on the cathode faces. Using this pile of electrodes, a mixture of 1500 g benzene, 4120 g methanol, 345 g tetramethylammonium fluoride and 34 g hydrogen fluoride was electrolyzed for 5 hours 53 minutes at 51 amperes and a cell voltage of 32 to 35 volts (corresponding to 1500 amperes/hour), after which period of time the electrolyte 4.00 mols benzoquinone-tetramethyl-ketal, corresponding to a current efficiency of 42.9% of the theory.

EXAMPLE 3

A continuous-flow cell was provided with a framed anode of platinized stainless steel (Pt layer 10 microns), a stainless steel cathode framed in the same manner and 2 equally framed bipolar electrodes of platinum-coated stainless steel. The dimensions of all electrodes were 194×194×3 mm, the active electrode area was 150×170 mm (corresponding to 255 $cm^2$). The rim (thickness 2 mm) of the metal plates (dimensions 180×180×3 mm), that is, the range outside of the active electrode area, was covered by the polyethylene frame having a width of 22 and 12 mm, respectively, and a thickness of 3 and 4 mm, respectively. Three polyethylene nets having dimensions of 150×170×1 mm were placed between the electrodes. Using this pile of electrodes, a mixture of 2625 g benzene, 8000 g methanol, 770 g tetramethylammonium fluoride and 40 g hydrogen fluoride was electrolyzed for 19 hours at 51 amperes (corresponding to 2907 amperes/hour) and a cell voltage of 17 to 20 volts, after which time the electrolyte contained 7.57 mols benzoquinone-tetramethyl-ketal, corresponding to a current efficiency of 4.19% of the theory.

What is claimed is:

1. A continuous flow cell for electrochemical reaction with an electrolyte comprising a housing; a plurality of bipolar electrodes provided in said housing, each bipolar electrode being formed of an electrically active plate and a frame of electrically non-conducting material secured to the periphery of said active plate; an inlet tunnel in said housing having an inlet to introduce said electrolyte from beneath said electrode plates; a collecting tunnel in said housing disposed above and common to all of said electrode plates for collecting electrolyte which flows thereto; said electrode plates being arranged in a stack with the plane of each plate being parallel to the direction in which said electrolyte flows in said housing from said inlet to said collecting tunnel; and means for supplying an electric current to said cell.

2. The cell of claim 1 wherein the peripheral edge of each electrically active plate is tapered and inserted into said frame.

3. The cell of claim 1 or 2 wherein at least portions of said frame on opposite sides of each plate, extending in the direction parallel to said direction in which said electrolyte flows, are thicker than said plate so as to form spacers between adjacent plates.

4. The cell of claim 3 wherein said frame consists of a thermoplastic material.

5. The cell of claim 4 wherein said thermoplastic material is a polyolefin.

6. The cell of claim 3 wherein each said plate is comprised of a glass-like carbon.

7. The cell of claim 6 wherein the cathode face of each said plate is coated with a material to reduce hydrogen overvoltage.

8. The cell of claim 7 wherein the material coated on said cathode face is selected from the group consisting of titanium carbide and tungsten carbide.

9. A capillary gap cell for electrolysis, comprising a housing; a plurality of bipolar electrodes provided in said housing, each electrode being formed of an electrically active plate and a frame of electrically non-conducting material secured to the periphery of said active plate, said electrode plates being arranged in a stack with the plane of each plate being parallel to the direction in which electrolyte flows in said cell; those portions of said frame on opposite sides of said plate, extending in said parallel direction, being thicker than the thickness of said plate so as to form spacers between adjacent plates; and means for supplying an electric current to said plates.

* * * * *